US008875333B2

(12) United States Patent
Im et al.

(10) Patent No.: US 8,875,333 B2
(45) Date of Patent: Nov. 4, 2014

(54) WASHING MACHINE PERFORMING SHOWER RINSING AND METHOD OF CONTROLLING THE SAME

(75) Inventors: Tae Hui Im, Suwon-Si (KR); Jung Ran Jung, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1046 days.

(21) Appl. No.: 12/458,381

(22) Filed: Jul. 9, 2009

(65) Prior Publication Data

US 2010/0154132 A1 Jun. 24, 2010

(30) Foreign Application Priority Data

Dec. 19, 2008 (KR) ..... 10-2008-129825

(51) Int. Cl.
*D06F 35/00* (2006.01)

(52) U.S. Cl.
CPC ..... *D06F 35/006* (2013.01); *D06F 2232/06* (2013.01); *D06F 2204/065* (2013.01); *D06F 2202/085* (2013.01)
USPC ..... 8/159

(58) Field of Classification Search
CPC ..... D06F 35/006; D06F 2232/06
USPC ..... 8/158–159; 68/23 R, 23.5, 23.6, 205 R, 68/207, 208
See application file for complete search history.

(56) References Cited

U.S. PATENT DOCUMENTS

| | | | | | |
|---|---|---|---|---|---|
| 4,784,666 | A * | 11/1988 | Brenner et al. | ..... | 8/137 |
| 5,167,722 | A * | 12/1992 | Pastryk et al. | ..... | 134/33 |
| 5,191,668 | A * | 3/1993 | Euler et al. | ..... | 8/158 |
| 5,219,370 | A * | 6/1993 | Farrington et al. | ..... | 8/158 |
| 7,146,669 | B2 * | 12/2006 | Orszulik | ..... | 8/158 |
| 7,171,714 | B2 * | 2/2007 | Pyo et al. | ..... | 8/159 |
| 7,376,997 | B2 * | 5/2008 | Kim et al. | ..... | 8/159 |
| 2003/0208852 | A1 * | 11/2003 | Hardaway et al. | ..... | 8/158 |
| 2004/0010860 | A1 * | 1/2004 | Johanski et al. | ..... | 8/158 |
| 2005/0022318 | A1 * | 2/2005 | Kim et al. | ..... | 8/159 |
| 2008/0229517 | A1 * | 9/2008 | Amarillas et al. | ..... | 8/159 |

FOREIGN PATENT DOCUMENTS

| | | |
|---|---|---|
| JP | 2001-25598 | 1/2001 |
| KR | 10-0232819 | 9/1999 |

* cited by examiner

*Primary Examiner* — Joseph L Perrin
(74) *Attorney, Agent, or Firm* — Staas & Halsey LLP

(57) ABSTRACT

A method of controlling a washing machine to perform shower rinsing, including repeatedly performing a process to store water supplied to a washing tub in the washing tub and discharge the water from the washing tub while rotating the washing tub during the shower rinsing is described. In a state in which laundry clings to the washing tub by a spin-drying operation, it may be possible to rinse the laundry clinging to the upper part of the washing tub using water supplied to the washing tub rotating at the predetermined velocity, to rinse the laundry clinging to the lower part of the washing tub using the water stored in the washing tub according to the off operation of a drainage unit, and to periodically replace water necessary to rinse the laundry by discharging the used water from the washing tub according to the periodic operation of the drainage unit.

6 Claims, 6 Drawing Sheets

FIG. 6

| | SPIN-DRYING | SHOWER RINSING | INTERMEDIATE SPIN-DRYING | | |
|---|---|---|---|---|---|
| VELOCITY (rpm) | 800rpm<br>0rpm | 40rpm | | 800rpm | 0rpm |
| WATER SUPPLY VALVE | OFF | ON | OFF | OFF | OFF |
| DRAINAGE PUMP | ON | ON/OFF | ON | ON | ON |
| MOTOR | OFF | ON | ON | ON | OFF |
| TIME(min) | - | 1.5 | - | 1 | - |

WASHING MACHINE PERFORMING SHOWER RINSING AND METHOD OF CONTROLLING THE SAME

CROSS-REFERENCE TO RELATED APPLICATIONS

This application claims the benefit of Korean Patent Application No. 2008-0129825, filed on Dec. 19, 2008 in the Korean Intellectual Property Office, the disclosure of which is incorporated herein by reference.

BACKGROUND

1. Field

One or more embodiments of the present disclosure relate to a washing machine that performs a shower rinsing operation on laundry while supplying water into a rotating washing tub and a method of controlling the same.

2. Description of the Related Art

Generally, a washing machine is an apparatus that separates contaminants from laundry by applying energy, such as impact, to the laundry. Based on how the energy is applied to the laundry, the washing machine may be classified as a pulsator washing machine, an agitator washing machine, or a drum washing machine. The pulsator washing machine performs washing using force imparted to water by rotating a disc-shaped pulsator. The agitator washing machine performs washing by rotating a blade-shaped agitator protruding upward from the center of a washing tub in alternating directions. The drum washing machine washes laundry by dropping the laundry through the rotation of a drum such that impact is applied to the laundry.

The washing machine performs a washing operation to wash laundry with detergent-dissolved water, a soak rinsing operation to soak laundry in water and rinse the laundry soaked in the water, and a spin-drying operation to remove water from the laundry.

In particular, an extra-large washing machine may perform a shower rinsing operation to rotate a washing tub while laundry clings to the inner circumference of the washing tub during a spin-drying operation, after the spin-drying operation, and, at the same time, rinse the laundry while supplying water into the washing tub. The shower rinsing operation reduces the amount of water used for rinsing as compared with the soak rinsing operation; however, water does not uniformly permeate all of the laundry, with the result that it may not be possible to uniformly rinse the laundry.

SUMMARY

Additional aspects and/or advantages will be set forth in part in the description which follows and, in part, will be apparent from the description, or may be learned by practice of the disclosure.

One or more embodiments of the present disclosure are achieved by providing, a method of controlling a washing machine to perform shower rinsing. The method includes repeatedly performing a process to store water supplied to a washing tub in the washing tub and to discharge the water from the washing tub to the outside while rotating the washing tub during the shower rinsing.

The rotating the washing tub may include rotating a pulsator disposed in the washing tub in one direction simultaneously with the washing tub.

The rotating the washing tub may include maintaining the rotational velocity of the washing tub at a predetermined velocity.

The shower rinsing may be performed after a spin-drying, and the method may further include supplying water toward laundry clinging to the inner circumference of the washing tub according to the spin-drying operation.

The method may further include, in a normal course, when the shower rinsing is completed, performing an intermediate spin-drying operation, and, when the intermediate spin-drying operation is completed, further performing the shower rinsing operation.

The method may further include, when the shower rinsing is completed, performing an intermediate spin-drying operation, and comparing the number of the shower rinsing times with the number of shower rinsing times set by a user to determine whether the shower rinsing is to be further performed.

The method may further include, when the shower rinsing is completed, comparing the water level of the washing tub with a predetermined spin-drying water level to determine whether drainage is to be performed.

One or more embodiments of the present disclosure are achieved by providing a method of controlling a washing machine to perform shower rinsing. The method includes repeatedly performing a process to store water supplied to a washing tub in the washing tub and to discharge the water from the washing tub to the outside by driving a drainage pump at predetermined time intervals while rotating the washing tub during the shower rinsing.

The method may further include, when the shower rinsing is completed, stopping the supply of water to the washing tub, and driving the drainage pump, while accelerating the washing tub, to perform intermediate spin-drying.

One or more embodiments of the present disclosure are achieved by providing a method of controlling a washing machine. The method includes, when an operation of the washing machine is a rinsing operation, supplying water to a washing tub while rotating the washing tub, storing the water in the washing tub, when the water level of the water stored in the washing tub reaches a first water level, discharging the water, when the water level of the water stored in the washing tub reaches a second water level, during the discharge of the water, stopping the discharge of the water, and repeatedly storing the water in the washing tub and discharging the water from the washing tub during the rinsing operation.

The second water level may be adjacent to the first water level or to the bottom of the washing tub.

The rinsing operation may include shower rinsing, performed after a spin-drying, to supply the water toward laundry clinging to the inner circumference of the washing tub according to the spin-drying operation.

The rotating the washing tub may include rotating the washing tub at a predetermined velocity in one direction.

One or more embodiments of the present disclosure are achieved by providing a washing machine to perform shower rinsing. The washing machine includes a water supply unit to supply water to a washing tub, a washing motor to rotate the washing tub, a drainage unit to discharge the water from the washing tub to the outside, and a controller to control the water supply unit, the washing motor, and the drainage unit, during the shower rinsing, to repeatedly perform a process to store water supplied to the washing tub in the washing tub and discharge the water from the washing tub to the outside while rotating the washing tub.

The washing machine may further include a water level sensing unit to sense a water level of the washing tub. The controller may control the drainage unit to be turned on when the water level of the washing tub reaches a first water level, and control the drainage unit to be turned off when the water level of the washing tub reaches a second water level.

The second water level may be adjacent to the first water level or to the bottom of the washing tub.

The controller may control driving of the drainage unit at predetermined time intervals to discharge the water from the washing tub to the outside.

The washing machine may further include a pulsator disposed in the washing tub, and the controller may control rotation of the washing motor to rotate the washing tub and the pulsator in one direction.

The washing machine may further include a velocity sensing unit to sense a rotational velocity of the washing motor, and the controller may control the rotational velocity of the washing motor to maintain the rotational velocity of the washing motor at a predetermined velocity.

The washing machine may further include a manipulation unit configured to be manipulated by a user, and the controller may set the number of the shower rinsing times based on a manipulation signal input from the manipulation unit, and control the rinsing operation to be performed the set number of shower rinsing times.

The shower rinsing may be a rinsing to supply water toward laundry clinging to the inner circumference of the washing tub after a spin-drying operation is completed.

In a normal course, the controller may control the washing motor to be accelerated, when the shower rinsing is completed, to perform an intermediate spin-drying operation, and control the shower rinsing operation to be further performed when the intermediate spin-drying operation is completed.

The washing machine may further include a water level sensing unit to sense a water level of the washing tub, and the controller may compare the water level of the washing tub with a predetermined spin-drying water level, when the shower rinsing is completed, to determine whether drainage is to be performed, and control an intermediate spin-drying operation to be performed.

One or more embodiments of the present disclosure are achieved by providing a method of controlling a washing machine to perform shower rinsing. The method includes rotating a washing tub at a predetermined velocity, supplying water to the washing tub, turning a drainage pump off to store the supplied water in the washing tub, turning the drainage pump on to discharge the water stored in the washing tub to the outside, and repeatedly performing a process to store the water in the washing tub and to discharge the water from the washing tub to the outside for a predetermined time.

The method may further include, when the predetermined time has elapsed, turning the drainage pump on to discharge the water from the washing tub to the outside, and accelerating the washing tub to perform intermediate spin-drying.

The rotation of the washing tub and the supply of the water may be performed simultaneously.

The rotation of the washing tub, the supply of the water, and on and off driving of the drainage pump may be performed simultaneously.

The rotation of the washing tub and the supply of the water may be continuously performed during one shower rinsing cycle.

BRIEF DESCRIPTION OF THE DRAWINGS

These and/or other aspects and advantages of the disclosure will become apparent and more readily appreciated from the following description of the embodiments, taken in conjunction with the accompanying drawings of which:

FIG. 6 is a view illustrating shower rinsing control of a washing machine according to a further embodiment.

DETAILED DESCRIPTION

Figure 1:
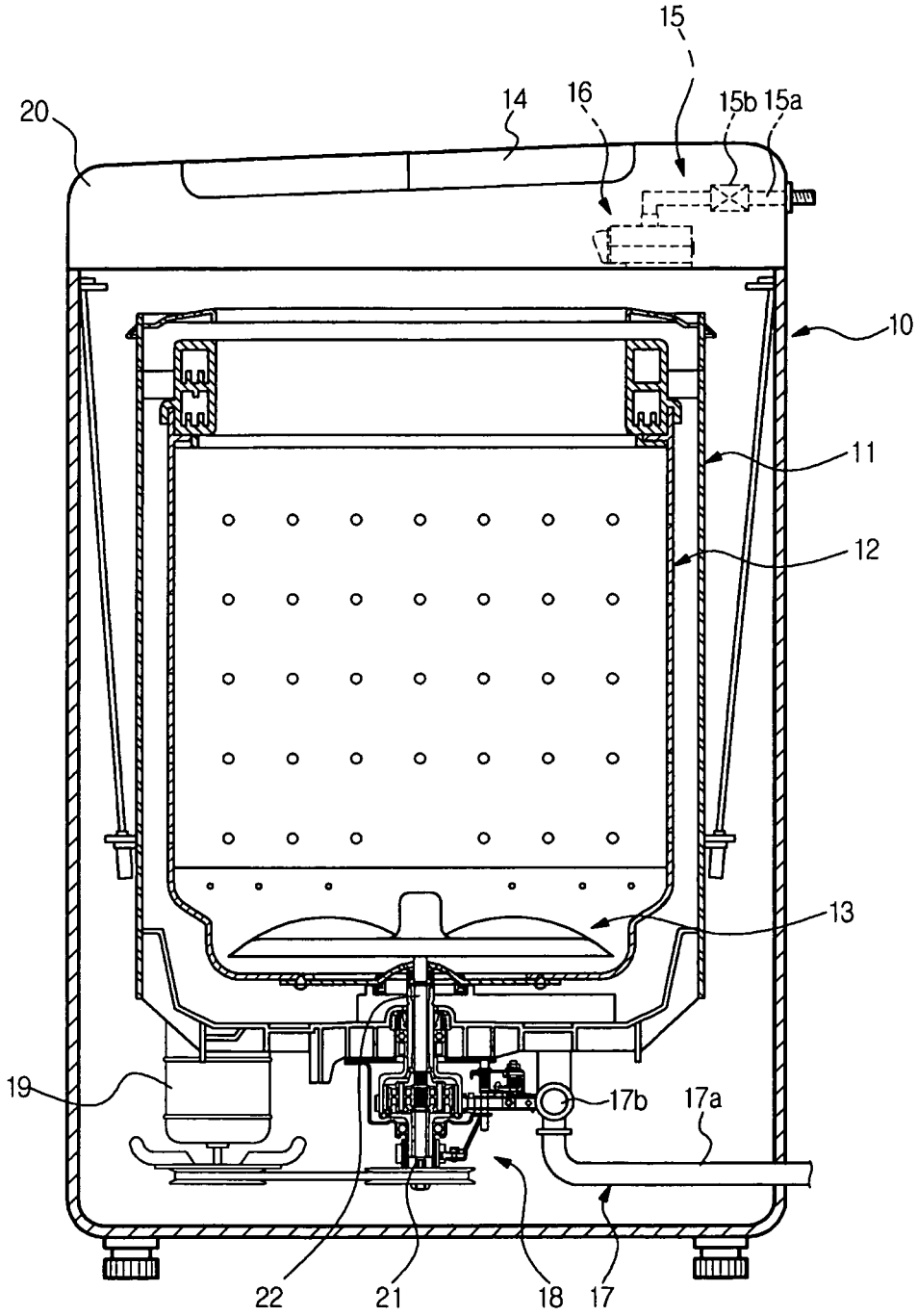
FIG. 1 is a view illustrating a washing machine according to an embodiment.

Reference will now be made in detail to embodiments of the present disclosure, examples of which are illustrated in the accompanying drawings, wherein like reference numerals refer to like elements throughout.

FIG. 1 is a view illustrating a washing machine according to an embodiment. The washing machine may include, for example, a machine body 10 forming the external appearance of the washing machine, a water tub 11 installed in the machine body 10 to receive water, a washing tub 12 rotatably installed in the water tub 11, the washing tub 12 having holes through which water flows between the water tub 11 and the washing tub 12, and a pulsator 13 rotatably installed at the inner bottom of the washing tub 12 to create washing water current.

The washing machine may further include, for example, a top cover 20 installed at the top of the machine body 10, an opening (not shown) formed at the top cover 20 to allow laundry to be put into the washing tub 12 or taken out of the washing tub 12 there through, and a door 14 to open and close the opening. That is, the door 14 may be opened such that laundry to be washed is put into the washing tub 12 and the washed laundry is taken out of the washing tub 12. At the top cover 20, there is also a manipulation unit 110 to manipulate the operation of the washing machine. The manipulation unit 110 is manipulated by a user. The manipulation unit 110 transmits a manipulation signal to a controller 140, which will be described below with reference to FIG. 2.

The washing machine may further include, for example, a water supply unit 15 to supply water from an external water supply source to the water tub 11 and the washing tub 12, a detergent supply unit 16 connected to the water supply unit 15, such that water is supplied from the water supply unit 15 to the detergent supply unit 16, to supply detergents, such as cleanser and fabric softener, placed therein by a user, to the water tub 11 and the washing tub 12 together with water, a drainage unit 17 to drain water used for washing from the water tub 11 and the washing tub 12, a power transmission 18, having a washing shaft 21 to rotate the pulsator 13 and a spin-drying shaft 22 to rotate the washing tub 12, to selectively transmit a rotary force to the washing tub 12 and the pulsator 13 while the washing shaft and the spin-drying shaft 22 are engaged with each other or disengaged from each other, and a washing motor 19 to generate a rotary force and transmit the generated rotary force to the power transmission 18.

The water supply unit 15 has a water supply pipe 15*a* to which water from the external water supply source is transmitted and a water supply valve 15*b* to open and close the water supply pipe 15*a*. The drainage unit 17 has a drainage pipe 17*a* to guide water from the water tub 11 to the outside and a drainage pump 17*b* to pump water out of the water tub 11 such that the water is discharged from the water tub 11 through the drainage pipe 17*a*.

The detergent supply unit 16 has a detergent box, having a discharge hole, installed such that the detergent supply unit 16 is withdrawn outside. That is, when the detergent box is withdrawn outside by a user, and detergent is put in the detergent box, the detergent supply unit 16 keeps the detergent in the detergent box. When water is supplied from the water supply unit to the detergent supply unit 16, the detergent supply unit 16 discharges the detergent with the water into the washing tub 12 through the discharge hole. The discharge hole is located adjacent to the inner circumference of the washing tub 12 such that water discharged through the discharge hole comes into contact with the laundry.

The washing motor 19 rotates only the washing shaft in alternating directions, while the washing shaft and the spin-drying shaft 22 are disengaged from each other, for the pulsator 13 to perform stirring in alternating directions, such that laundry soaking, detergent dissolution, a washing operation, a soak rinsing operation, and untangling of laundry are performed.

Also, the washing motor 19 rotates the washing shaft 21 and the spin-drying shaft 22 in the forward direction or in the reverse direction, while the washing shaft 21 and the spin-drying shaft 22 are engaged with each other, for the pulsator 13 and the washing tub 12 to be rotated simultaneously in one direction such that a shower rinsing operation and a spin-drying operation are performed.

Figure 2:
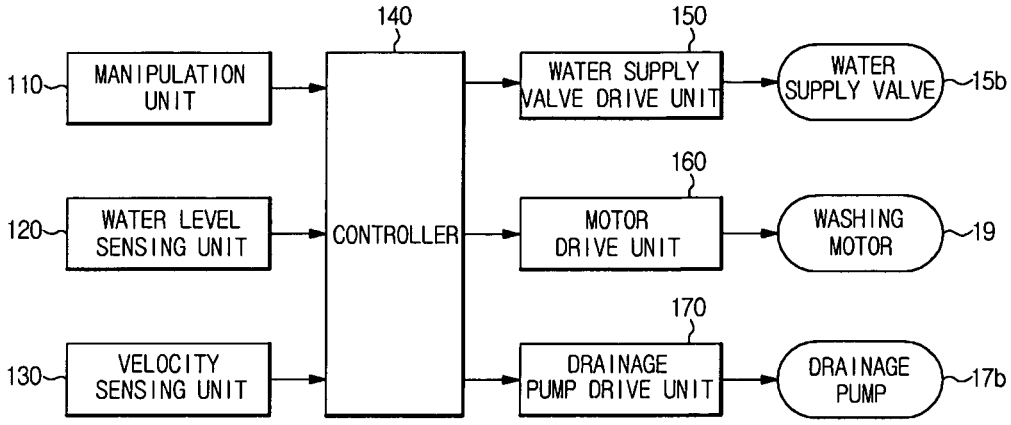
FIG. 2 is a control block diagram of a washing machine according to the embodiment.

FIG. 2 is a control block diagram of a washing machine according to the embodiment. The washing machine may include, for example, a manipulation unit 110, a water level sensing unit 120, a velocity sensing unit 130, a controller 140, a water supply valve drive unit 150, a washing motor drive unit 160, and a drainage pump drive unit 170.

The manipulation unit 110 allows a user to manipulate the operation of the washing machine. When the user selects an operation course and start of the operation, suspension of the operation, or stop of the operation, the manipulation unit 110 transmits a manipulation signal to the controller 140.

The water level sensing unit 120 senses the level of water supplied into the washing tub 12 and the water tub 11, when the water is supplied through the water supply unit 15, and transmits the sensed water level to the controller 140.

The velocity sensing unit 130 senses the rotational velocity of the washing motor 19 and transmits the sensed velocity of the washing motor 19 to the controller 140.

When a spin-drying operation is completed, the controller 140 transmits a washing motor 19 drive signal (an ON signal) to the washing motor drive unit 160 and a water supply valve 15*b* drive signal (an ON signal) to the water supply drive unit 150 and, at the same time, periodically transmits On and OFF signals to the drainage pump drive unit 170, to perform a shower rinsing operation in which the rotational velocity of the washing motor 19 is maintained at a predetermined velocity (e.g., about 40 rpm), water is supplied into the water tub 11 and the washing tub 12 while the washing tub 12 is rotated, and, at the same time, water is periodically discharged from the water tub 11 and the washing tub 12 to the outside.

When the water level of the water tub 11 and the washing tub 12 reaches a first predetermined water level, the controller 140 transmits an ON signal to the drainage pump drive unit 170 to drive the drainage pump 17*b*. When the water level of the water tub 11 and the washing tub 12 reaches a second predetermined water level during the driving of the drainage pump 17*b*, the controller 140 transmits an OFF signal to the drainage pump drive unit 170 to stop the driving of the drainage pump 17*b*. That is, the controller 140 compares the water level of the water tub 11 and the washing tub 12 with the first and second water levels and controls the drainage pump 17*b* to be repeatedly turned on or off such that the water is periodically discharged from the water tub 11 and the washing tub 12 to the outside, and therefore, water having a level appropriate for shower rinsing is stored in the water tub 11 and the washing tub 12. The second water level is adjacent to the first water level. The drainage pump 17*b* is turned on or off based on the first water level and the second water level to uniformly maintain the water level of the washing tub.

When the laundry clings to the inner circumference of the washing tub 12 as a result of the spin-drying operation, and, in this state, the washing tub 12 and the pulsator 13 are rotated at a predetermined velocity, some of the water supplied from the water supply unit 15 falls on the laundry clinging to the upper part of the inner circumference of the washing tub. As a result, the water penetrates into the laundry to rinse the laundry clinging to the upper part of the inner circumference of the washing tub 12. The remaining water supplied from the water supply unit 15 is stored in the lower parts of the water tub 11 and the washing tub 12. The stored water penetrates into the laundry clinging to the lower part of the inner circumference of the washing tub 12 to rinse the laundry clinging to the lower part of the inner circumference of the washing tub 12. The water penetrates into the laundry clinging to the upper and lower parts of the inner circumference of the washing tub 12 by the shower rinsing, thereby uniformly rinsing all of the laundry.

When the water level of the water tub 11 and the washing tub 12 exceeds a predetermined spin-drying water level after completion of the shower rinsing operation, the controller 140 drives the drainage pump 17*b* to discharge the water from the water tub 11 and the washing tub 12 to the outside, and controls an intermediate spin-drying operation to be performed. The controller 140 transmits a water supply valve 15*b* drive stop signal (an OFF signal) to the water supply valve drive unit 160 to close the water supply pipe 15*a*, transmits a washing motor 19 drive signal to the washing motor drive unit 160 to accelerate the washing motor 19 to a spin-drying velocity such that the water is separated from the laundry, and drives the drainage pump 17*b* to perform an intermediate spin-drying operation in which the water separated from the laundry is discharged to the outside, e.g., outside of the washing machine. In addition, when a predetermined time for which the shower rinsing operation is performed has elapsed, the controller 140 detects the balance of the laundry in the washing tub 12. When it is determined that the laundry in the washing tub 12 is unbalanced, the controller 140 controls a soak rinsing operation to be performed. When it is determined that the laundry in the washing tub 12 is balanced, the controller 140 controls an intermediate spin-drying operation to be performed.

The water supply valve drive unit 150 transmits a water supply valve 15*b* on/off signal corresponding to a command of the controller 140 to the water supply valve 15*b* to open or close the water supply valve 15*b*.

The washing motor drive unit 160 transmits a washing motor 19 drive signal corresponding to a command of the controller 140 to the washing motor 19, such that the washing motor 19 rotates to selectively rotate the washing tub 12 and the pulsator 13 using the rotary force of the washing motor 19.

A washing machine according to another embodiment is identical in control construction to that according to the previous embodiment except for on/off control of the drainage pump 17*b* during a shower rinsing operation. Therefore, the same construction of this embodiment as the previous embodiment will not be described. Hereinafter, only the control of the drainage pump 17*b* during the shower rinsing operation will be described.

The controller 140 controls the washing motor 19 to be maintained at a predetermined velocity, drives the water supply valve 15*b* to open the water supply pipe 15*a*, and, at the same time, periodically drives the drainage pump 17*b* to perform a shower rinsing operation in which water is supplied into the washing tub 12, and, at the same time, the water is discharged from the water tub 11 and the washing tub 12 to the outside.

At this time, the controller 140 compares the water level of the water tub 11 and the washing tub 12 with first and second predetermined water levels. When it is determined that the water level of the water tub 11 and the washing tub 12 reaches the first water level, the controller 140 transmits a drive signal (an ON signal) to the drainage pump drive unit 170 to drive the drainage pump 17*b* such that the water is discharged from the water tub 11 and the washing tub 12 to the outside. When it is determined that the water level of the water tub 11 and the washing tub 12 reaches the second water level, after the discharge of the water from the water tub 11 and the washing tub 12, the controller 140 transmits a drive stop signal (an OFF signal) to the drainage pump drive unit 170 to stop the driving of the drainage pump 17*b* such that water supplied from the water supply unit 15 is stored in the water tub 11 and the washing tub 12. The second water level is adjacent to the bottom of the washing tub 12. The on/off driving of the drainage pump 17*b* is controlled based on the first water level and the second water level to repeatedly discharge water out of the washing tub 12 and to store new water, by which the water stored in the washing tub 12 is continuously replaced with new water, thereby improving laundry rinsing efficiency.

A washing machine according to a further embodiment performs shower rinsing operations based on the number of times of the shower rinsing operations set by a user, or the number of times of the shower rinsing operations corresponding to an operation course selected by the user. In an embodiment, a shower rinsing operation is comprised of a cycle of storing water supplied to the washing tub and of discharging the water from the washing tub. The washing machine according to the embodiment is identical in control construction to those according to the previous embodiments except for control of the number of times of the shower rinsing operations. Also, the controller 140 controls the shower rinsing operations to be performed twice for normal washing.

Figure 3:
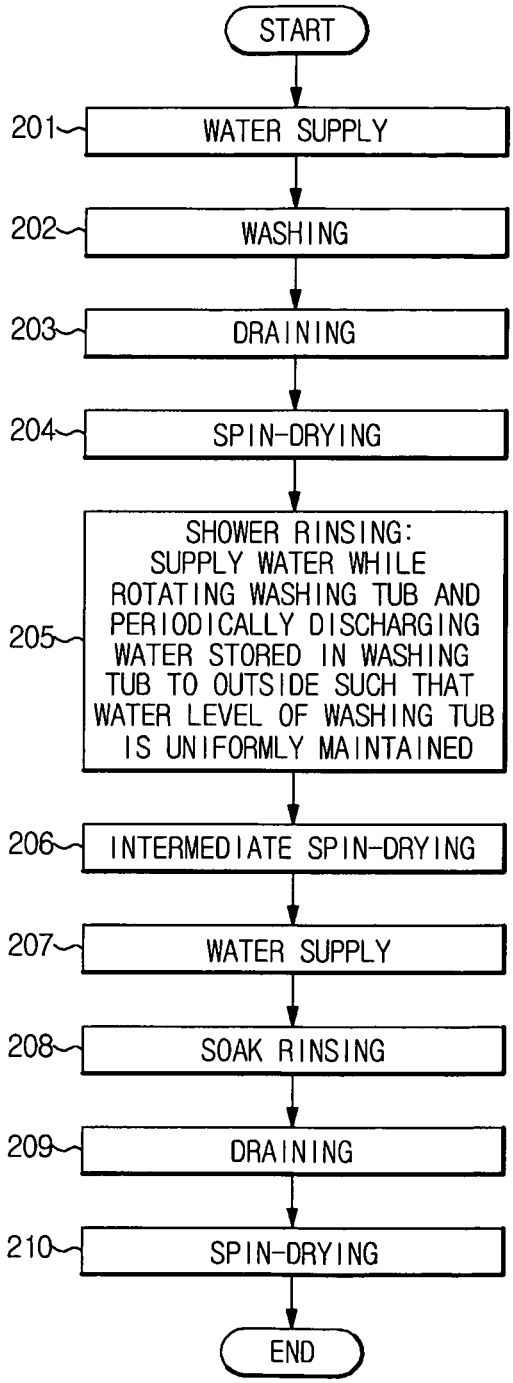
FIG. 3 is a control flow chart of the washing machine according to the embodiment.
Figure 4:
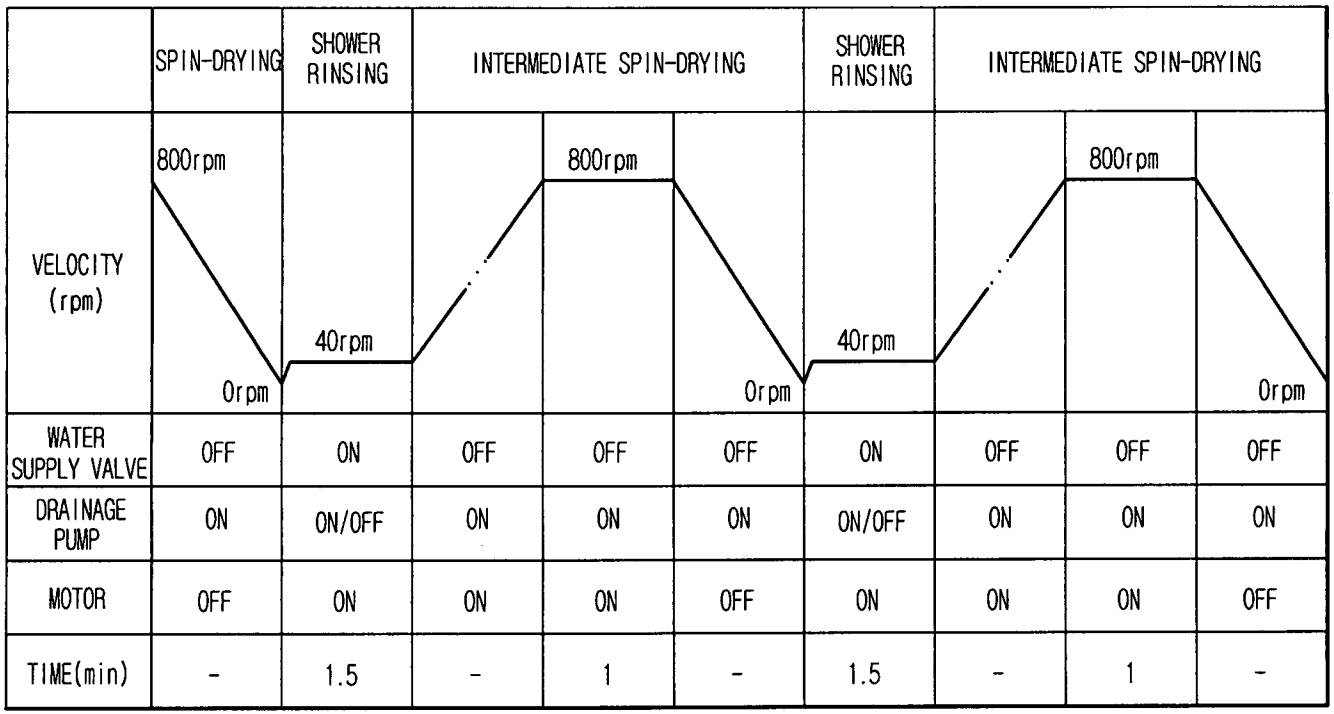
FIG. 4 is a view illustrating shower rinsing control of the washing machine according to the embodiment.

FIG. 3 is a control flow chart of the washing machine according to the embodiment of FIG. 2. The control method of the washing machine will be described with reference to FIGS. 3 and 4. FIG. 4 is a view illustrating shower rinsing control when the shower rinsing operations are performed twice. When normal washing is selected, the shower rinsing operations are performed twice.

When a user puts laundry in the washing tub 12 and detergent in the detergent supply unit 16, and selects an operation course using the manipulation unit 110, an operation corresponding to the selected operation course is performed. At this time, when the user selects a normal course and inputs a command to start the operation of the washing machine, the following rinsing operation is performed.

First, the washing motor 19 is rotated in alternating directions, while the washing shaft 21 and the spin-drying shaft 22 are disengaged from each other, such that the pulsator 13 performs stirring in alternating directions, and the weight of the laundry is sensed based on the rotational velocity or rotary force of the washing motor 19 due to the stirring operation of the pulsator 13. A reference water level of water to be supplied to the water tub 11 and the washing tub 12 during a washing operation or during a soak rinsing operation is set based on the sensed weight of the laundry. The rotation of the washing motor 19 is stopped, and the water supply valve 15*b* is turned on to open the water supply pipe 15*a* such that water is supplied from the external water supply source to the water tub 11 and the washing tub 12 (201). At this time, the water supplied through the water supply pipe 15*a* passes through the detergent supply unit 16, with the result that the water is supplied to the washing tub 12 together with the detergent put in the detergent supply unit 16.

During the supply of water necessary to perform the washing operation, the water level of water supplied to the water tub 11 and the washing tub 12 is sensed by the water level sensing unit 130, and the sensed water level of the water tub 11 and the washing tub 12 is compared with the reference water level at the washing operation to determine whether the water level of the water tub 11 and the washing tub 12 has reached the reference water level. When it is determined that the water level of the water tub 11 and the washing tub 12 has reached the reference water level, the water supply valve 15*b* is turned off to close the water supply pipe 15*a* such that the supply of water to the water tub 11 and the washing tub 12 is interrupted. When the supply of water is completed, the washing motor 19 is rotated in alternating directions, while the washing shaft 21 and the spin-drying shaft 22 are disengaged from each other, such that the pulsator 13 performs stirring in alternating directions to create water current in the washing tub 12. The detergent is dissolved in the water by the water current in the washing tub 12, and a washing operation is performed while the laundry put in the washing tub 12 is soaked (202).

When the washing operation is completed, the drainage pump 17*b* is turned on to discharge the water from the water tub 11 and the washing tub 12 to the outside (203). When the drainage operation is completed, the washing motor 19 is accelerated to a spin-drying velocity (e.g., about 800 rpm) in the forward direction or in the reverse direction, while the washing shaft 21 and the spin-drying shaft 22 are engaged with each other, to perform a spin-drying operation (204).

When the spin-drying operation is completed, as shown in FIG. 4, the washing motor 19 is turned on to maintain the rotational velocity of the washing motor 19 at a predetermined velocity (e.g., about 40 rpm), and the water supply valve 15*b* is opened to supply water to the water tub 11 and the washing tub 12 through the water supply pipe 15*a*. At the same time, the drainage pump 17*b* is periodically turned on and off to perform a shower rinsing operation for a predetermined time (e.g., about 1.5 minutes) while the water is discharged from the water tub 11 and the washing tub 12 to the outside (205).

In the shower rinsing operation, the water level of the water stored in the water tub 11 and the washing tub 12 is sensed, and it is determined whether the water level of the water tub 11 and the washing tub 12 has reached a first predetermined water level. When it is determined that the water level of the water tub 11 and the washing tub 12 has reached the first predetermined water level, the water level of the water tub 11 and the washing tub 12 is sensed while the drainage pump 17*b* is driven, and it is determined whether the water level of the water tub 11 and the washing tub 12 has reached a second predetermined water level. When it is determined that the water level of the water tub 11 and the washing tub 12 has reached the second predetermined water level, the driving of the drainage pump 17*b* is stopped, and the process to sense the water level of the water tub 11 and the washing tub 12 is repeated such that water having a water level appropriate for rinsing the laundry clinging to the lower part of the inner circumference of the washing tub 12 is stored in the water tub 11 and the washing tub 12. The second water level is adjacent to the first water level. The drainage pump 17*b* is turned on or off based on the first water level and the second water level to uniformly maintain the water level of the washing tub 12.

A force parallel to the pulsator 13 is applied to the laundry put in the washing tub 12 by a centrifugal force generated during the spin-drying operation, with the result that the laundry is separated. The separated laundry clings to the inner circumference of the washing tub 12. In this state, the spin-drying operation is completed, and a shower rinsing operation is performed. At this time, water supplied through the water supply unit 15 and the water stored in the washing tub 12 permeate the laundry clinging to the inner circumference of the washing tub 12 to rinse the laundry. That is, the laundry clinging to the upper part of the inner circumference of the washing tub 12 is rinsed by the water supplied through the water supply unit 15, and the laundry clinging to the lower part of the inner circumference of the washing tub 12 is rinsed by the water stored in the washing tub 12, whereby all of the laundry is uniformly rinsed.

When the shower rinsing operation is completed, the water supply valve 15*b* is closed, the driving of the drainage pump 17*b* is stopped, and the driving of the washing motor 19 is stopped. Subsequently, the water level and balance of the water tub 11 and the washing tub 12 are determined.

That is, when the shower rinsing operation is completed, the water level of the water tub 11 and the washing tub 12 is sensed, and the sensed water level of the water tub 11 and the washing tub 12 is compared with a predetermined spin-drying water level. When it is determined that the water level of the water tub 11 and the washing tub 12 exceeds the spin-drying water level, the drainage pump 17*b* is driven to discharge the water from the water tub 11 and the washing tub 12 to the outside. And the balance of the laundry in the washing tub 12 is sensed. When it is determined that the laundry in the washing tub 12 is unbalanced, water is further supplied to the water tub 11 and the washing tub 12, and a soak rinsing operation is performed.

While most of the laundry clings to the inner circumference of the washing tub 12, the shower rinsing operation is performed. When the washing tub 12 is in a balanced state, the shower rinsing operation is normally operated. On the other hand, when the washing tub 12 is in an unbalanced state, it is determined that the rinsing of the laundry has not been performed, and the soak rinsing is performed.

Consequently, when it is determined that the laundry in the washing tub 12 is balanced, the washing motor 19 is accelerated to a predetermined spin-drying velocity (e.g., about 800 rpm), and the drainage pump 17*b* is driven to perform an intermediate spin-drying operation to discharge the water separated from the laundry out of the washing tub 12 for a predetermined time (e.g., about 1 minute). When the predetermined time (e.g., about 1 minute) has elapsed, the driving of the washing motor 19 is stopped. At this time, the drainage pump 17*b* is continuously driven until the water left in the washing machine is completely discharged outside.

When the intermediate spin-drying operation is completed, the washing motor 19 is driven, and the rotational velocity of the washing motor 19 is compared with a predetermined velocity (e.g., about 40 rpm). When the rotational velocity of the washing motor 19 reaches the predetermined velocity, the rotational velocity of the washing motor 19 is maintained at the predetermined velocity, and the water supply valve 15*b* is opened to supply water to the washing tub 12 rotating at the predetermined velocity through the water supply pipe 15*a*. At the same time, the drainage pump 17*b* is periodically turned on and off to perform the shower rinsing operation for a predetermined time (e.g., about 1.5 minutes) once more while the water is discharged from the water tub 11 and the washing tub 12 to the outside, and, when the shower rinsing operation is completed, an intermediate spin-drying operation is performed for a predetermined time (e.g., about 1 minute) (206). That is, when the operation course selected by the user is the normal washing, the shower rinsing operations are performed twice.

When the shower rinsing operation is completed, the water supply valve 15*b* is opened to supply water to the water tub 11 and the washing tub 12 (207), and the washing tub 12 and the pulsator 13 are rotated in alternating directions to perform soak rinsing (208). When the soak rinsing is completed, the driving of the drainage pump 17*b* is controlled to discharge the water from the water tub 11 and the washing tub 12 to the outside (209). Subsequently, the driving of the washing motor 19 is controlled to spin-dry the laundry (210).

Figure 5:
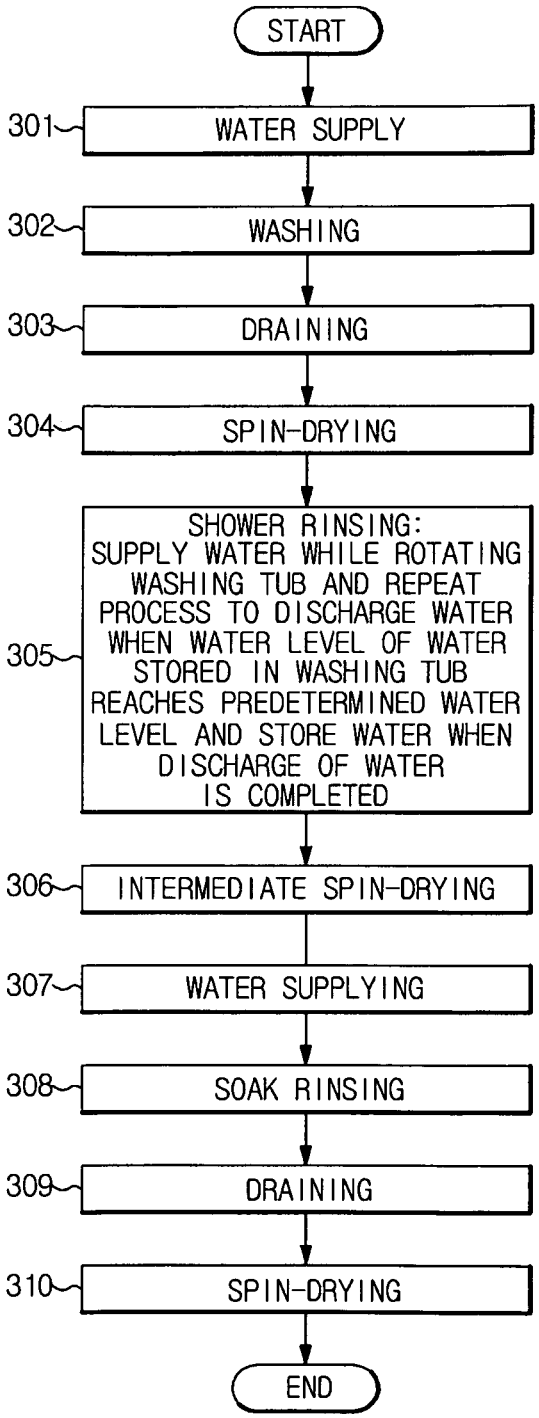
FIG. 5 is a control flow chart of a washing machine according to another embodiment.

FIG. 5 is a control flow chart of a washing machine according to another embodiment.

When a user puts laundry in the washing tub 12 and detergent in the detergent supply unit 16, and selects an operation course using the manipulation unit 110, an operation corresponding to the selected operation course is performed. At this time, when the user selects a normal course and inputs a command to start the operation of the washing machine, the following rinsing operation is performed.

First, the washing motor 19 is rotated in alternating directions, while the washing shaft 21 and the spin-drying shaft 22 are disengaged from each other, such that the pulsator 13 performs stirring in alternating directions, and the weight of the laundry is sensed based on the rotational velocity or rotary force of the washing motor 19 due to the stirring operation of the pulsator 13. A reference water level of water to be supplied to the water tub 11 and the washing tub 12 during a washing operation or during a soak rinsing operation is set based on the sensed weight of the laundry. The rotation of the washing motor 19 is stopped, and the water supply valve 15*b* is turned on to open the water supply pipe 15*a* such that water is supplied from the external water supply source to the water tub 11 and the washing tub 12 (301). At this time, the water supplied through the water supply pipe 15*a* passes through the detergent supply unit 16, with the result that the water is supplied to the washing tub 12 together with the detergent put in the detergent supply unit 16.

During the supply of water necessary to perform the washing operation, the water level of water supplied to the water tub 11 and the washing tub 12 is sensed by the water level sensing unit 130, and the sensed water level of the water tub 11 and the washing tub 12 is compared with the reference water level at the washing operation to determine whether the water level of the water tub 11 and the washing tub 12 has reached the reference water level. When it is determined that the water level of the water tub 11 and the washing tub 12 has reached the reference water level, the water supply valve 15*b* is turned off to close the water supply pipe 15*a* such that the supply of water to the water tub 11 and the washing tub 12 is interrupted. When the supply of water is completed, the washing motor 19 is rotated in alternating directions, while the washing shaft 21 and the spin-drying shaft 22 are disengaged from each other, such that the pulsator 13 performs stirring in alternating directions to create water current in the washing tub 12. By the water current, a washing operation is performed while the laundry put in the washing tub 12 is soaked and the detergent is dissolved in the water in the washing tub 12 (302).

When the washing operation is completed, the drainage pump 17*b* is turned on to discharge the water from the water tub 11 and the washing tub 12 to the outside (303). When the drainage operation is completed, the washing motor 19 is accelerated to a spin-drying velocity (e.g., about 800 rpm) in the forward direction or in the reverse direction, while the washing shaft 21 and the spin-drying shaft 22 are engaged with each other, and the drainage pump 17*b* is driven, such that the water separated from the laundry is discharged from the washing tub 12 to the outside, to perform a spin-drying operation (304).

When the spin-drying operation is completed, the washing motor 19 is turned on to maintain the rotational velocity of the washing motor 19 at a predetermined velocity, and the water supply valve 15*b* is opened to supply water to the washing tub 12 through the water supply pipe 15*a*. At the same time, the drainage pump 17*b* is periodically turned on and off to perform a shower rinsing operation for a predetermined time (e.g., about 1.5 minutes) while the water is discharged from the water tub 11 and the washing tub 12 to the outside (305).

In the shower rinsing operation, the water level of the water stored in the water tub 11 and the washing tub 12 is sensed, and the water level of the water tub 11 and the washing tub 12 is compared with first and second predetermined water levels. At this time, it is determined whether the water level of the water tub 11 and the washing tub 12 has reached the first water level. When it is determined that the water level of the water tub 11 and the washing tub 12 has reached the first water level, the drainage pump 17*b* is driven to discharge the water from the water tub 11 and the washing tub 12 to the outside. When the discharge of the water from the water tub 11 and the washing tub 12 to the outside is completed after a predetermined time has passed, and the water level of the washing tub 12 reaches the second water level, the driving of the drainage pump 17*b* is stopped, and the process to store the water supplied from the water supply unit 15 in the water tub 11 and the washing tub 12 is repeated. The first water level is a water level appropriate for rinsing the laundry clinging to the lower part of the inner circumference of the washing tub 12. The second water level is adjacent to the bottom of the washing tub 12. As the water is discharged out of the washing tub 12, until the water level of the washing tub 12 reaches the second water level, most of the water stored in the washing tub 12 is replaced.

Furthermore, the shower rinsing operation may be performed such that, when the spin-drying operation is completed, the washing motor 19 is driven and maintained at a predetermined velocity, the water supply valve 15*b* is opened to supply water to the washing tub 12 through the water supply pipe 15*a*, and, at the same time, the drainage pump 17*b* is turned on and off at predetermined time intervals to periodically discharge the water from the water tub 11 and the washing tub 12 to the outside. That is, the water supply valve 15*b* is opened, during the shower rinsing, to supply water to the washing tub 12 through the water supply pipe 15*a*, and the supplied water is stored in the washing tub 12. At this time, when the time for which the water is stored in the washing tub 12 reaches a predetermined time, the drainage pump 17*b* is turned on to discharge the water from the washing tub 12 to the outside. When the time for which the water is discharged reaches a predetermined time, the drainage pump 17*b* is turned off to stop the discharge of the water and to store water supplied from the water supply pipe 15*a* again. In this way, the drainage pump 17*b* is turned on and off at the predetermined time intervals, during the shower rinsing, to repeatedly store and discharge water.

A force parallel to the pulsator 13 is applied to the laundry put in the washing tub 12 during the spin-drying operation, with the result that the laundry is separated. The separated laundry clings to the inner circumference of the washing tub 12. In this state, the spin-drying operation is completed, and a shower rinsing operation is performed. At this time, water supplied through the water supply unit 15 and the water stored in the washing tub 12 permeate the laundry clinging to the inner circumference of the washing tub 12 to rinse the laundry. That is, the laundry clinging to the upper part of the inner circumference of the washing tub 12 is rinsed by the water supplied through the water supply unit 15, and the laundry clinging to the lower part of the inner circumference of the washing tub 12 is rinsed by the water stored in the washing tub 12, whereby all of the laundry is uniformly rinsed.

When the shower rinsing operation is completed, the water supply valve 15*b* is closed, and the driving of the washing motor 19 and the drainage pump 17*b* is stopped. Subsequently, the water level of the water tub 11 and the washing tub 12 is sensed, and the sensed water level of the water tub 11 and the washing tub 12 is compared with a predetermined spin-drying water level. When it is determined that the water level of the water tub 11 and the washing tub 12 is below the spin-drying water level, it is determined whether the washing tub 12 is in a balanced state. On the other hand, when it is determined that the water level of the water tub 11 and the washing tub 12 exceeds the spin-drying water level, the drainage pump 17*b* is driven to discharge the water from the water tub 11 and the washing tub 12 to the outside, and then it is determined whether the washing tub 12 is in the balanced state.

The determination of whether the washing tub 12 is in the balanced state is performed as follows. When the balance of the laundry in the washing tub 12 is sensed, and it is determined that the laundry in the washing tub 12 is unbalanced, the driving of the water supply unit 15 and the washing motor 19 is controlled to supply water to the water tub 11 and the washing tub 12, and a soak rinsing operation is performed. On the other hand, when it is determined that the laundry in the washing tub 12 is balanced, the washing motor 19 is accelerated to a predetermined spin-drying velocity (e.g., about 800 rpm), and an intermediate spin-drying operation is performed. That is, the washing motor 19 is accelerated to the spin-drying velocity to separate the water from the laundry. At this time, an intermediate spin-drying operation is performed for a predetermined time (e.g., about 1 minute) such that the water separated from the laundry is discharged from the washing tub 12 to the outside by the driving of the drainage pump 17*b*.

When the intermediate spin-drying operation is completed, the washing motor 19 is accelerated to a predetermined velocity. When the rotational velocity of the washing motor 19 reaches the predetermined velocity, the rotational velocity of the washing motor 19 is maintained at the predetermined velocity, and the water supply valve 15*b* is opened to supply water to the washing tub 12 through the water supply pipe 15*a*. At the same time, the drainage pump 17*b* is periodically turned on and off to perform the shower rinsing operation once more while the water is discharged from the water tub 11 and the washing tub 12 to the outside. When the shower rinsing operation is completed, the drainage and the balance are determined, and an intermediate spin-drying operation is performed (306).

When the intermediate spin-drying operation is completed, the water supply valve 15*b* is opened to supply water to the water tub 11 and the washing tub 12 (307), and the washing tub 12 and the pulsator 13 are rotated in alternating directions to perform soak rinsing (308). When the soak rinsing is completed, the driving of the drainage pump 17*b* is controlled to discharge the water from the water tub 11 and the washing tub 12 to the outside (309). Subsequently, the driving of the washing motor 19 is controlled to spin-dry the laundry (310).

Consequently, it may be possible to rinse the laundry clinging to the upper part of the inner circumference of the washing tub 12 using water supplied to the washing tub 12 rotating at the predetermined velocity, to rinse the laundry clinging to the lower part of the inner circumference of the washing tub 12 using the water stored in the washing tub 12 according to the off operation of the drainage unit 17, and to periodically replace water necessary to rinse the laundry by discharging the water used to rinse the laundry from the washing tub 12 to the outside according to the periodic operation of the drainage unit 17, thereby improving laundry rinsing efficiency.

Hereinafter, a control sequence of a washing machine according to a further embodiment will be described with reference to FIG. 6.

When a user puts laundry in the washing tub 12 and detergent in the detergent supply unit 16, and selects an operation course or the number of shower rinsing times using the manipulation unit 110, an operation corresponding to the manipulation signal is performed. At this time, when the user sets the number of shower rinsing times and inputs a command to start the operation of the washing machine, the following rinsing operation is performed.

First, the washing motor 19 is rotated in alternating directions such that the pulsator 13 performs stirring in alternating directions, and the weight of the laundry is sensed based on the rotational velocity or rotary force of the washing motor 19 due to the stirring operation of the pulsator 13. A reference water level of water to be supplied to the water tub 11 and the washing tub 12 during a washing operation or during a soak rinsing operation is set, and water is supplied from the external water supply source to the water tub 11 and the washing tub 12. A washing operation is performed by the stirring operation of the pulsator 13 in alternating directions. When the washing operation is completed, a drainage operation is performed to discharge the water out of the washing tub 12. Subsequently, the washing motor 19 is accelerated to a spin-drying velocity (e.g., about 800 rpm) to perform a spin-drying operation.

When the spin-drying operation is completed, the washing motor 19 is driven to maintain the rotational velocity of the washing motor 19 at a predetermined velocity (e.g., about 40 rpm), and the water supply valve 15*b* is opened to supply water to the water tub 11 and the washing tub 12 through the water supply pipe 15*a*. At the same time, the drainage pump 17*b* is periodically turned on and off to perform a shower rinsing operation for a predetermined time (e.g., about 1.5 minutes) while the water is discharged from the water tub 11 and the washing tub 12 to the outside.

At this time, the water level of the water stored in the water tub 11 and the washing tub 12 is sensed, and it is determined whether the water level of the water tub 11 and the washing tub 12 has reached a first predetermined water level. When it is determined that the water level of the water tub 11 and the washing tub 12 has reached the first water level, the water level of the water stored in the water tub 11 and the washing tub 12 is sensed, while the drainage pump 17*b* is driven, to determine whether the sensed water level of the water tub 11 and the washing tub 12 has reached a second predetermined water level. When it is determined that the water level of the water tub 11 and the washing tub 12 has reached the second water level, the driving of the drainage pump 17*b* is stopped, and the process to sense the water level of the water tub 11 and the washing tub 12 is repeated such that water having a level appropriate for rinsing the laundry clinging to the lower part of the inner circumference of the washing tub 12 is stored in the water tub 11 and the washing tub 12.

When the shower rinsing operation is completed, the water supply valve 15*b* is closed, the driving of the drainage pump 17*b* is stopped, and the driving of the washing motor 19 is stopped. Subsequently, the water level and the balance of the water tub 11 and the washing tub 12 are determined.

That is, when the shower rinsing operation is completed, the water level of the water tub 11 and the washing tub 12 is sensed, and the sensed water level of the water tub 11 and the washing tub 12 is compared with a predetermined spin-drying water level. When the water level of the water tub 11 and the washing tub 12 exceeds the spin-drying water level, the drainage pump 17*b* is driven to discharge the water from the water tub 11 and the washing tub 12 to the outside, and the balance of the laundry in the washing tub 12 is sensed. When it is determined that the laundry in the washing tub 12 is unbalanced, water is further supplied to the water tub 11 and the washing tub 12, and a soak rinsing operation is performed. When it is determined that the laundry in the washing tub 12 is balanced, the washing motor 19 is accelerated to a predetermined spin-drying velocity (e.g., about 800 rpm), and the drainage pump 17*b* is driven to perform an intermediate spin-drying operation to discharge the water separated from the laundry out of the washing tub 12 for a predetermined time (e.g., about 1 minute). When the predetermined time (e.g., about 1 minute) has elapsed, the driving of the washing motor 19 is stopped.

Subsequently, the number of shower rinsing times is checked, and the checked number of the shower rinsing times is compared with the number of times set by a user. When the number of the shower rinsing times is not equal to the number of times set by the user, shower rinsing and intermediate spin-drying operations are further performed. When the number of the shower rinsing times is equal to the number of times set by the user, the shower rinsing operation is stopped, the water supply valve 15*b* is opened to supply water to the water tub 11 and the washing tub 12, the washing tub 12 and the pulsator 13 are rotated in alternating directions to perform soak rinsing. When the soak rinsing is completed, the driving of the drainage pump 17*b* is controlled to discharge the water out of the water tub 11 and the washing tub 12, and the driving of the washing motor 19 is controlled to spin-dry the laundry.

FIG. 6 is a view illustrating shower rinsing control when a shower rinsing operation is performed once. When the user sets the number of shower rinsing times to 1, the shower rinsing operation is performed once, and then the supply of water and a soak rinsing operation are performed.

When the user sets the number of shower rinsing times, or selects the operation course, as described above, the shower rinsing operation is performed through the above-described process by the number of shower rinsing times set by the user or the number of shower rinsing times corresponding to the operation course.

As is apparent from the above description, it may be possible for an embodiment to rinse the laundry clinging to the upper part of the inner circumference of the washing tub 12 using water supplied to the washing tub 12 rotating at the predetermined velocity, in a state in which the laundry clings to the inner circumference of the washing tub 12 by the spin-drying operation, to rinse the laundry clinging to the lower part of the inner circumference of the washing tub 12 using the water stored in the washing tub 12 according to the off operation of the drainage unit, and to periodically replace water necessary to rinse the laundry by discharging the water used to rinse the laundry from the washing tub 12 to the outside according to the periodic operation of the drainage unit, thereby improving laundry rinsing efficiency.

It may be possible for another embodiment to direct water supplied to the washing tub 12 toward the laundry clinging to the washing tub 12, thereby improving rinsing efficiency of the laundry clinging to the upper part of the inner circumference of the washing tub 12.

Although a few embodiments have been shown and described, it would be appreciated by those skilled in the art that changes may be made in these embodiments without departing from the principles and spirit of the present disclosure, the scope of which is defined in the claims and their equivalents.

What is claimed is:

1. A method of controlling a washing machine to perform shower rinsing, the method comprising:

performing a shower rinsing by rotating a washing tub while simultaneously directing water supplied to the washing tub toward laundry clinging to an upper part of an inner circumference of the washing tub due to the rotating;

repeatedly performing a process to store water supplied to the washing tub as a result of the shower rinsing up to a first predetermined level that is set to be sufficiently high to rinse laundry clinging to a lower part of the inner circumference of the washing tub as a result of the rotating of the washing tub while being insufficiently high to rinse the laundry clinging to the upper part of the inner circumference of the washing tub and to discharge the water from the washing tub to an outside while rotating the washing tub until the water reaches a second predetermined level that is lower than the first predetermined level.

2. The method according to claim 1, wherein the rotating of the washing tub comprises rotating a pulsator installed within the washing tub in one direction simultaneously with the washing tub.

3. The method according to claim 1, wherein the rotating of the washing tub comprises maintaining a rotational velocity of the washing tub at a predetermined velocity.

4. The method according to claim 1, wherein the shower rinsing is performed after a spin-drying; and wherein the laundry clinging to the upper part of the inner circumference of the washing tub is clinging as a result of the spin-drying operation.

5. The method according to claim 1, further comprising:

performing an intermediate spin-drying operation when the shower rinsing is completed; and performing another rinsing operation when the intermediate spin-drying operation is completed.

6. The method according to claim 1, further comprising, when the shower rinsing is completed, comparing a water level of the washing tub with a predetermined spin-drying water level to determine whether drainage is to be performed.

* * * * *